United States Patent [19]

Herron et al.

[11] Patent Number: 4,489,367

[45] Date of Patent: Dec. 18, 1984

[54] HEADLIGHT PERMISSIBLE FOR USE IN EXPLOSIVE ATMOSPHERES

[76] Inventors: Charles R. Herron, 660 Tanager Dr., Bluefield, Va. 24605; Marvin L. Haines, Rte. 3, Box 76-D1, Princeton, W. Va. 24740; Roger L. O'Quinn, 300 Hale St., Pearisburg, Va. 24134

[21] Appl. No.: 532,872

[22] Filed: Sep. 16, 1983

[51] Int. Cl.[3] ..... F21V 3/00

[52] U.S. Cl. ..... 362/311; 362/267; 362/375; 362/294; 362/376; 362/369; 362/390; 362/374; 362/396

[58] Field of Search ..... 362/164, 165, 267, 297, 362/306, 310, 365, 417, 440, 399, 400, 311, 294, 369, 374–376, 396

[56] References Cited

U.S. PATENT DOCUMENTS

| | | | |
|---|---|---|---|
| 3,939,337 | 2/1976 | Oda et al. | 362/365 X |
| 3,953,725 | 4/1976 | Ketler et al. | 362/222 |
| 3,976,564 | 8/1976 | Holder | 362/119 X |
| 4,091,444 | 5/1978 | Mori | 362/164 X |
| 4,158,880 | 6/1979 | McJunkin, Jr. | 362/367 X |
| 4,186,432 | 1/1980 | Hamacher | 362/164 X |
| 4,282,564 | 8/1981 | McJunkin, Jr. et al. | 362/217 |
| 4,387,417 | 6/1983 | Plemmons et al. | 362/306 X |
| 4,388,679 | 6/1983 | Blaisdell et al. | 362/306 X |
| 4,399,497 | 8/1983 | Druffel | 362/417 X |

*Primary Examiner*—Peter A. Nelson

[57] ABSTRACT

Headlight comprises a hollow metal housing with a circular rim defining a forward opening. A side outlet socket assembly is provided in the housing, at the rearward end, to receive the transverse pins of a side-pin style bulb. The housing rim has external threads on the outside and a conical, tapered surface on the inside. A separate bulb and lens retainer ring has an external conical, tapered surface, sealingly engageable with the conical surface in the housing rim to provide a tapered flame path in the event of an internal explosion and also allows easy removal of the bulb and lens. The bulb and lens retainer ring has an inner bore with counterbores at the front and rear ends. A rubberlike ring in the rear counterbore provides an elastic seat for a flange on the front of the bulb and cushions it against shock. A heavy lens is potted by epoxy, or otherwise permanently sealed into the front counterbore. A generally U- or V-shaped spring bail has a flat intermediate portion pressed across the rear end of the bulb base and has two transverse tine portions engaged within diametrically opposed holes in the bulb and lens retainer ring to hold the bulb, retainer ring, and lens as a separately removable and replaceable sub-assembly. A front cover ring has internal threads engageable with the external threads on the housing rim and has a radially inwardly extending flange engageable with the front edge of the bulb and lens retainer ring to press the conical surfaces into sealing, explosion-proof engagement when the cover ring is tightened.

7 Claims, 6 Drawing Figures

Fig. 6
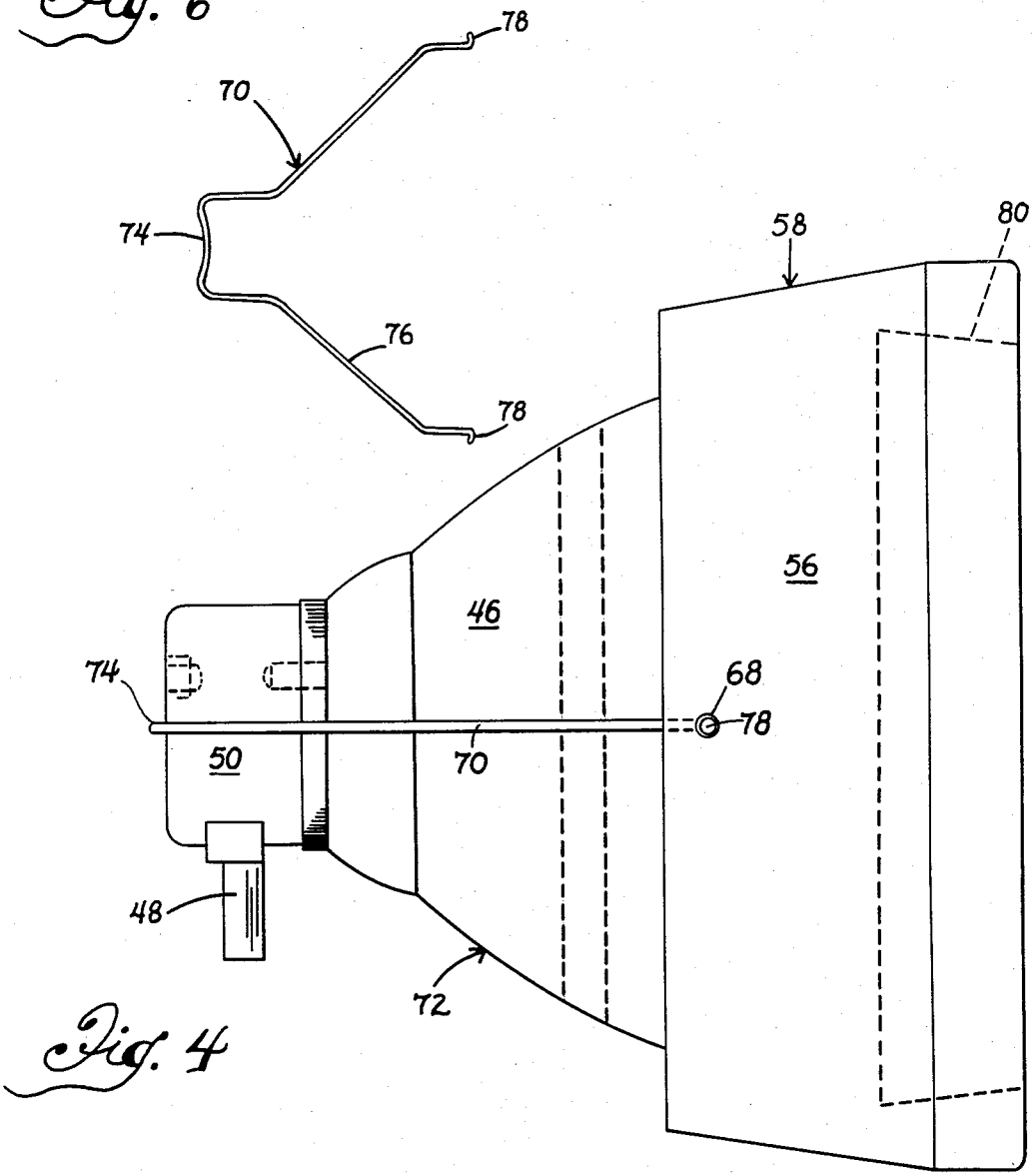
Fig. 4
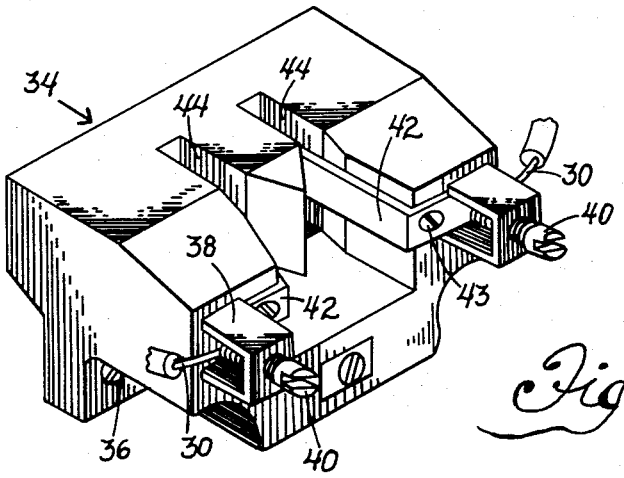
Fig. 5

HEADLIGHT PERMISSIBLE FOR USE IN EXPLOSIVE ATMOSPHERES

BACKGROUND OF THE INVENTION

This invention relates generally to headlights. More specifically, it relates to headlights which are permissible for use in potentially explosive atmospheres such as underground coal mines where explosive concentrations of methane may exist at times.

Headlights for underground coal mining machinery must be of very strong construction to contain an explosion in the event a methane-air mixture seeps in and is ignited by an electrical arc or heat within the housing. Temperature rise, and a dynamic gas effect called "pressure piling", produced by exploding a stoichiometric methane-air mixture in a sealed enclosure such as a headlight housing will cause a sudden pressure increase well in excess of 150 psi. It is therefore evident that enclosures for explosion-proof electrical equipment must be of much heavier construction than those commonly used for general consumer or non-mining industrial applications. A headlight housing for use in explosive atmospheres may be only six to eight inches in diameter but the walls must be one-fourth to one-half inch thick, with multiple reinforcing ribs, to prevent rupture and possible explosion of an entire mine section if the gas within the housing is ignited.

In addition to the high strength requirements, a mine headlight must be easy to take apart and re-assemble in constricted spaces where visibility is poor. The need for bulb replacement and internal maintenance from time to time make it impractical to permanently seal the housing, however desirable that might be from the standpoint of safety.

Engineers confronted with the problem of making a headlight strong for safety, yet capable of being taken apart for bulb replacement and maintenance, have properly been unwilling to trade off the safety of a rugged housing for features which might make it easy to change the bulb. As a result, headlights are basically safe for use in explosive atmospheres, but bulb replacement is often a substantial chore.

SUMMARY OF THE INVENTION

Therefore, a principal object of the present invention is to provide, for use in potentially explosive atmospheres, a headlight which is sufficiently strong and rugged that it can contain an internal explosion without igniting an external explosive atmosphere, yet which is readily disassemblable and reassemblable to facilitate bulb replacement and maintenance.

Another object is to provide a bulb and lens retainer ring which is sealingly engageable with the headlight housing through matching conical bearing surfaces providing a tapered flame path and which surfaces are readily separable to facilitate disassembly.

Another object is to provide such a headlight assembly in which a lens retainer ring and a bulb are held together by a spring bail as a separate sub-assembly which may be readily bench-assembled and serviced remote from the headlight.

Further objects of the invention will appear as the description proceeds.

BRIEF DESCRIPTION OF THE DRAWINGS

Other objects and advantages will be apparent from the following description taken in connection with the accompanying drawings in which:

FIG. 4 is a view of a sub-assembly shown in FIG. 1 consisting of a bulb and a bulb and lens retainer ring held together by means of a spring bail for insertion as a unit in the headlight housing;

FIG. 5 is a perspective view of a side outlet socket assembly shown in FIGS. 1 and 2; and FIG. 6 is a separate view of the wire spring bail shown in some of the previous figures.

Like parts are referred to by like reference characters.

DESCRIPTION OF THE PREFERRED EMBODIMENTS

Figure 1:
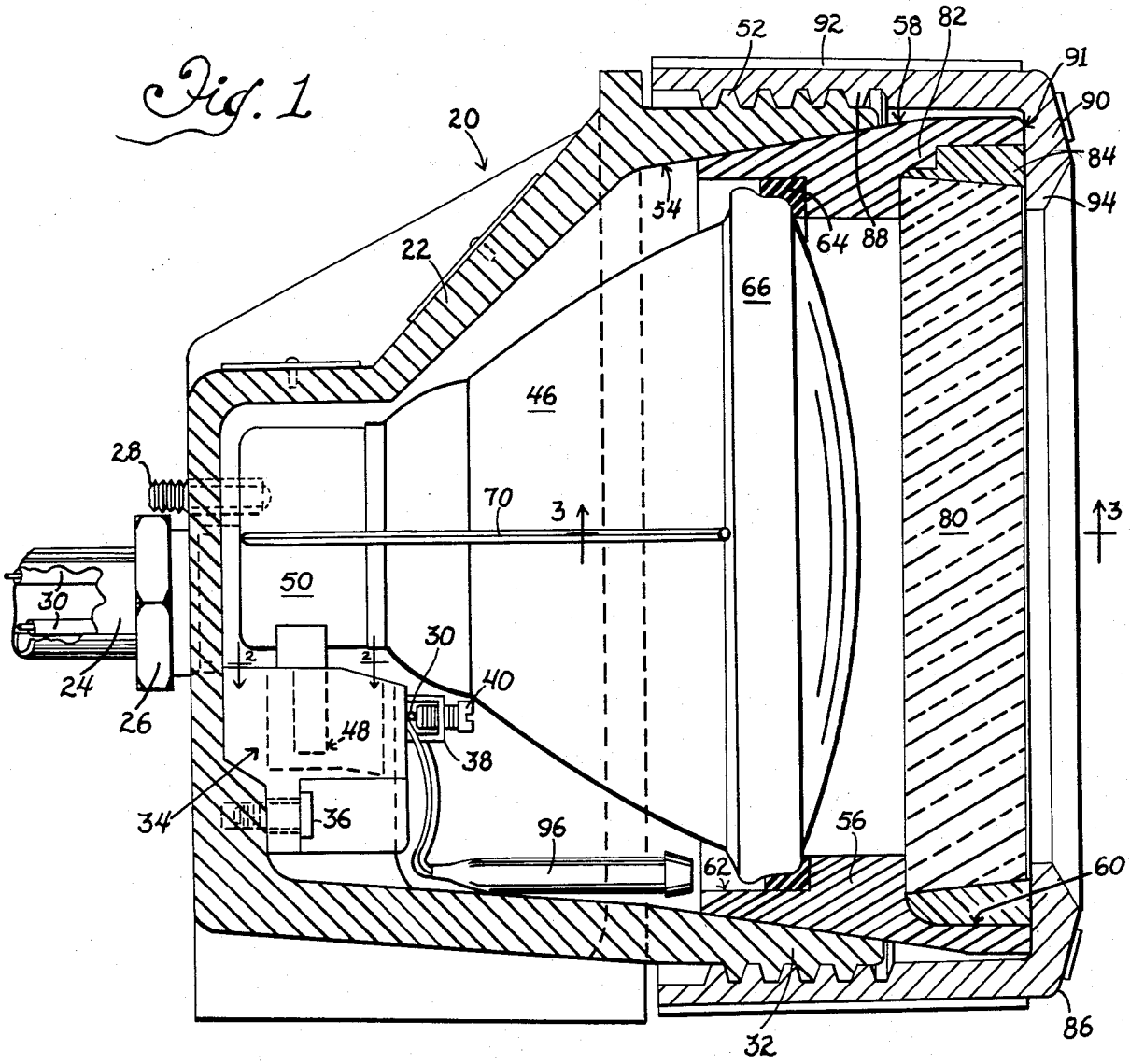
FIG. 1 is a vertical, longitudinal sectional view of a fully assembled permissible headlight illustrating a preferred form of the invention.

Referring now to the specific embodiment of the invention in the drawings, the headlight or explosion-proof closure 20 as a heavy, hollow housing or casing 22 made of non-sparking metal such as cast aluminum or zinc. An electrical conduit 24 is sealed to the back of the housing by a threaded gland bushing 26 locked against rotation by set screw 28. The conduit contains two or more insulated conductors 30 which are connected to energize the bulb within the housing as will be described. The housing is generally bell shaped, with a circular rim 32 defining a forward opening having a relatively deep inwardly converging frustoconical mouth. A socket assembly 34 is fastened as by screws 36 into the rearward end of the housing interior.

While other forms of socket assemblies may be used, the one shown here is of the side outlet type to minimize the overall hosing length required. It consists of a block of insulating plastics or ceramics material with a pair of hollow lugs 38 which act as terminal strips. Each lug has a contact set screw 40 pressing one of the conductors 30 against a corresponding contact blade 42. The latter extend into open sided slots or recesses 44.

A bulb 46 illustrated here is of the side pin type, having pins 48 extending transversely from the bulb base 50 and fitting into the slots 44 to engage blades 42. The latter are fastened to the socket assembly block by screws 43. Other styles of bulbs may be used depending on the particular socket assembly employed. In the present case, referring to FIG. 1, the bulb is seated by a simple, straight-in leftwise movement into the socket assembly, and is unseated by movement in the opposite direction.

The housing rim has an external, Acme-threaded surface 52 and an internal relatively deep, inwardly converging frustoconical mouth surface 54. A bulb and lens retainer ring or member 56 has an external relatively wide, inwardly converging frustoconical peripheral, surface 58 sealingly engageable with the internal conical surface 54 in surface to surface relationship. These two mouth surfaces provide a near zero clearance flame path of significant length, and make it easy to disassemble and re-assemble the headlight, even in the dark. The fore-and-aft length of the flame path defined by these interengaging conical surfaces should preferably be in the neighborhood of one and one-fourth inches or more. When the retainer 56 is fully inserted in the housing, there should not be more than 0.002 inches radial clearance at any given point around and throughout the length of the flame path defined by these frustoconical surfaces. This provides effective quenching of any ignited gases which are forced outwardly by an internal explosion. Any such gases reaching outside ambient atmosphere will be cooled below their ignition point and will not ignite even if it contains an explosive concentration of methane.

The bulb and lens retainer ring 56 has front and rear counterbores 60 and 62 respectively. A ring of elastic, rubberlike material 64 is positioned in the rear counterbore to engage the bulb flange 66 and thereby effectively cushion the bulb from shocks. The retainer ring 56 has a pair of diametrically opposed holes 68.

As best shown in FIGS. 1 and 4, a wire spring bail 70 is provided as means for detachably mounting the retaining ring on the bulb and thus for detachably holding the bulb against the cushion ring 64 to form a separately removable and replaceable subassembly 72 for enabling a defective light bulb readily to be replaced in the subassembly even in the close and often darkened operating quarters in a mine. As best shown in FIG. 6, the bail 70 is generally U- or V-shaped. It as an intermedate flat section 74 slightly bowed toward the base of the bulb and bearing against it when assembled. A pair of diagonal arms 76 extend forwardly alongside the bulb and terminate in outturned, transverse tine portion 78 which are seated in the retainer ring holes 68.

A heavy, substantially unbreakable lens cover 80 for protecting the bulb is fitted within front counterbore 60, centered by means of three tabs 82 and potted in place by means of epoxy 84 or similar material.

Figure 3:
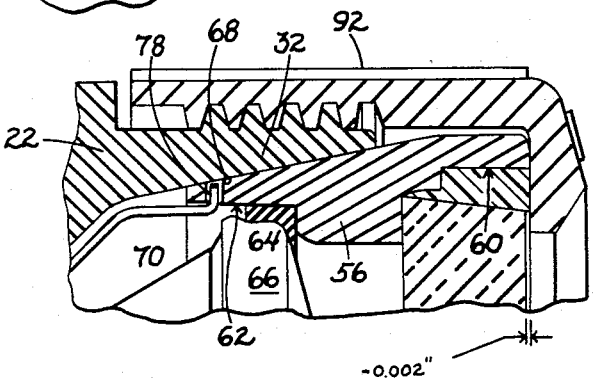
FIG. 3 is a fragmentary, sectional view of FIG. 1 taken on line 3—3.
Figure 2:
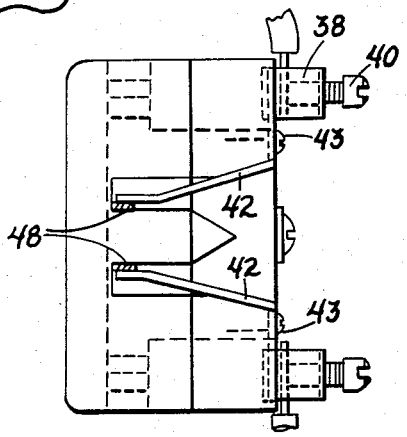
FIG. 2 is a fragmentary, sectional view of FIG. 1 taken on line 2—2.

A cover ring or member 86 has internal, course, Acme threads 88 engageable with the external threads 52 on the housing, with these threads constituting means for detachably securing the sub-assembly to the housing. A radially inwardly extending integral flange 90 is engageable with the front edge 92 of the retainer ring. Tightening the cover by means of a suitable spanner wrench (not shown) engaging outer ribs 92 presses the conical surfaces 54 and 58 into tight sealing engagement. The inner porion 94 of the cover ring flange overlaps the lens 80 as best shown in FIG. 1. This is a safety feature providing means in addition to the epoxy 84 for retaining the lens. For best results, the front face of the lens should be slightly behind but within 0.002 inches of the cover ring flange 90 as shown in FIG. 3. This insures that load from cover ring flange 90 will bear directly on front edge 91 of ring 56 while effectively retaining the lens 80.

Although not essential to the present invention, a neon lamp test indicator assembly 96 may be provided to check energization of the bulb circuit before inserting the bulb sub-assembly 72 in the housing.

Use and operation is believed to be apparent from the above description. Briefly, bulb 46 is placed in the retainer ring 56 with the bulb flange 66 seated against the cushion ring 64. The intermediate bail portion 74 is placed against the back end of the bulb base, and locked in place by inserting bail tine portions 78 into the holes 68. This provides the sub-assembly 72 which is then inserted as a unit by a backward sliding motion until the bulb pins 48 engage contact blades 42 and the two conical surfaces 54 and 58 are firmly seated against one another. Cover ring 86 is applied and tightened against front edge 91 of ring 56, making the headlight ready for use. Removal for replacing the bulb or other internal maintenance is carried out by resversing the above steps.

The embodiment of the present invention described has been necessarily specific for purposes of illustration. Alterations, extensions and modifications would be apparent to those skilled in the art. In particular, while the housing, the bulb retaining member, and the cover member are shown and described as being of circular shape in section, it is contemplated they may be of other sectional shapes.

The embodiments of the invention in which an exclusive property or privilege is claimed are defined as follows:

1. An explosion-proof closure for an electric light bulb having a base adapted to be connected to a source of electrical power for energizing the bulb, and a lens at the opposite end of the bulb, the closure being usable in potentially explosive atmospheres such as underground coal mines, the closure comprising:

a housing having an opening therein at one end thereof, constituting the forward end of the housing, an end wall at the opposite end of the housing, constituting the rearward end of the housing, and side walls intermediate the ends of the housing, the interior surface of the side walls at the forward end of the housing tapering inwardly from the exterior to the interior of the housing a relatively long distance so as to define a relatively deep inwardly converging mouth surface at the opening in the housing;

a bulb retaining member adapted to receive the lens of the bulb in generally surrounding relation, the retaining member being engageable generally at one end thereof, constituting its rearward end, with the bulb and having a lens cover at its opposite end, constituting its forward end, for protecting the lens, the retaining member further having a relatively wide peripheral surface tapering inwardly from the forward to rearward end thereof to define a relatively wide inwardly coverging retainer surface, said retainer surface being so sized and shaped relative to said mouth surface of the housing as to enable the retaining member to be fitted in the opening in the housing a significant depth, with the retainer surface and the mouth surface being in surface-to-surface sealing engagement along the entire peripheries thereof;

means for detachably mounting the retaining member on the bulb to form a bulb sub-assembly, separate from the housing, adapted to be positioned in the housing and close the opening therein; and means for detachably securing the sub-assembly to the housing, whereby with the sub-assembly secured to the housing said explosion-proof closure presents a relatively long flame path at the opening to the housing for quenching any ignited gases tending to flow outwardly from the closure between the housing and the retaining member on an internal explosion in the closure, and with the sub-assembly removed from the housing, a defective light bulb readily can be replaced in the sub-assembly.

2. An explosion-proof closure as set forth in claim 1 further comprising a socket mounted in the housing toward the rearward end wall thereof adapted to receive the base of the bulb for electrical interconnection therewith.

3. An explosion-proof closure as set forth in claim 2 wherein the base of the bulb has pins extending outwradly therefrom and said socket has recesses therein adapted to receive said pins on positioning the subassembly in the housing.

4. An explosion-proof closure as set forth in claim 1 wherein said means for detachably securing the subassembly to the housing comprises a generally annular cover member engageable with the housing and the retaining member.

5. An explosion-proof closure as set forth in claim 4 wherein said housing at its forward end, said retaining member, and said cover member are all of generally circular shape in section, and the housing and the cover member have interengageable threaded portions.

6. An explosion-proof closure as set forth in claim 5 wherein said mouth surface and said retainer surface are of generally frustoconical shape.

7. An explosion-proof closure as set forth in claim 1 wherein the means for detachably mounting the retaining member on the bulb comprises a generally U-shaped bail member having a central portion engageable with the base of the bulb and ends adapted to be secured to the retaining member.

* * * * *